United States Patent [19]

Yahiro et al.

[11] 4,084,648

[45] Apr. 18, 1978

[54] PROCESS FOR THE HIGH-PRESSURE GROUTING WITHIN THE EARTH AND APPARATUS ADAPTED FOR CARRYING OUT SAME

[75] Inventors: Teruo Yahiro, Tokyo; Hiroshi Yoshida, Tokorozawa, both of Japan

[73] Assignees: Kajima Corporation; Chemical Grout Company, Limited, both of Tokyo, Japan

[21] Appl. No.: 768,251

[22] Filed: Feb. 11, 1977

Related U.S. Application Data

[63] Continuation-in-part of Ser. No. 666,280, Mar. 12, 1976, Pat. No. 4,047,580, which is a continuation of Ser. No. 523,647, Nov. 13, 1974, abandoned.

[30] Foreign Application Priority Data

Feb. 12, 1976 Japan ..... 51-13296

[51] Int. Cl.[2] ..... E21B 7/18; E21B 33/138; E02D 3/12

[52] U.S. Cl. ..... 175/67; 61/36 R; 166/73; 166/223; 166/290

[58] Field of Search ..... 175/67, 14, 422; 299/16, 17; 166/285, 290, 222, 223, 67, 75, 78, 89, 90, 72, 73; 61/36 R, 36 B

[56] References Cited

U.S. PATENT DOCUMENTS

| | | | |
|---|---|---|---|
| 1,842,454 | 1/1932 | Lind | 175/14 |
| 2,518,591 | 8/1950 | Aston et al. | 175/422 X |
| 2,782,605 | 2/1957 | Wertz et al. | 61/36 R |
| 2,858,676 | 11/1958 | Ross | 61/36 R |
| 3,439,953 | 4/1969 | Pfefferle | 175/67 X |
| 3,572,839 | 3/1971 | Okabe | 175/67 X |
| 3,802,203 | 4/1974 | Ichise et al. | 61/36 R |
| 3,835,937 | 9/1974 | Hokao et al. | 175/14 X |

OTHER PUBLICATIONS

Yahiro et al., "Induction Grouting Method Utilizing High Speed Water Jet," Proceeding of 8th Internatl. Conference on Soil Mechanics, Moscow, Aug. 6–11, 1973, pp. 402–404, 359–362 and 181.

*Primary Examiner*—Stephen J. Novosad
*Attorney, Agent, or Firm*—Beveridge, DeGrandi, Kline & Lunsford

[57] ABSTRACT

This invention concerns with a high pressure grouting process. For lateral cutting of earth in the ground, a high speed core water jet, having its injection velocity equal to at least a half of the sonic one and surrounded by an air ring jet is used. For solidifying the crushed earth, a cement milk is used which is poured separately and at a lower level than that of the air-water combined jet into the space in the ground which space has been formed by the action of the core water jet.

7 Claims, 11 Drawing Figures

PROCESS FOR THE HIGH-PRESSURE GROUTING WITHIN THE EARTH AND APPARATUS ADAPTED FOR CARRYING OUT SAME

CROSS-REFERENCE TO RELATED APPLICATION

This applicaton is a continuation-in-part-application from the copending patent application Ser. No. 666,280, filed Mar. 12, 1976, now U.S. Pat. No. 4,047,580, which is in turn a continuation of the application Ser. No. 523,647 filed Nov. 13, 1974, now abandoned.

BACKGROUND OF THE INVENTION

This invention relates to a process for the high pressure grouting within the earth, and an apparatus adapted for carrying out same.

Before initiating the grouting process, it is naturally necessary to dig or bore mechanically or hydromechanically a vertical hole into the earth. It is known to construct sand seams and solidified bodies such as watertight walls by the so-called chemical grouting after digging, crushing, piercing and injecting with high-velocity jets of liquid such as water discharged from nozzles. High-velocity liquid jets are utilized in various construction techniques known as jet grouting, sand draining, jet piling, etc. These methods are effectively used because they are high in digging efficiency, provide high energy-density rates and require but a relatively small and simple device for producing high-velocity liquid jet. It is usually in the stratus with subterranean water or at the sea floor that high-velocity liquid jets are used for piercing and crushing. The water encountered in such locations rapidly slows down the velocity of jet liquid to reduce the working efficiency of the jet. Specifically, the in-water distance that the liquid jet can traverse ranges from about 1/10 to 1/15 of the in-air distance that the jet can traverse. This accounts for the inability of a high-velocity liquid jet to perform well when the jet of liquid is directed into a zone of water.

In order to increase the in-water distance that the high-velocity liquid jet traverses, it has been proposed in the prior art that an air jet be discharged from a ring-shaped nozzle surrounding the liquid jet nozzle so that the air jet will envelop the high-velocity liquid jet. Devices implementing this proposition have been successful in increasing the distance traversed by high-velocity liquid jets in water and, moreover, the air jet was noted to facilitate removal of loosened or crushed sand or the like because of its air lifting effect. An example of such a practice known in connection with jet grouting is disclosed in U.S. Pat. No. 3,802,203 which is incorporated herein as a known reference. In this known technique, a pair of coaxial jet nozzles is provided for supplying two liquid chemicals. We have experienced that with such known technique, the invading distance of these liquid jets is rather limited.

Even with a high-velocity liquid jet enveloped by air jet, a drawback has been noted in that there are fluctuations in the distance traversed by the liquid jet, termed the liquid jet distance in this specification, thus introducing discontinuous portions in watertight wall construction, or producing an anisotropic or non-homogeneous deposition of the cementing agent in solidifying work.

It is an object of the invention to provide an improved process for chemical grouting wherein the liquid jet-piercing distance into the earth is substantially improved for the purpose of enlarging the grouting zone.

It is a further object to provide an improved process of the above kind providing a possibility for solidifying the jet-crushed earth masses, even with use of common cement milk in place of the high price resin base solidifier.

It is a further object to provide a high efficiency and low cost process of the above kind over the known prior art.

These and further objects, features and advantages of the invention will become more apparent when read the following detailed description of the invention to be set forth with reference to the accompanying drawings.

BRIEF DESCRIPTION OF THE DRAWINGS

In the drawings:

FIG. 5 is a schematic sectional view of the double nozzle unit above referred to.

DETAILED DESCRIPTION OF THE INVENTION

Figure 1:
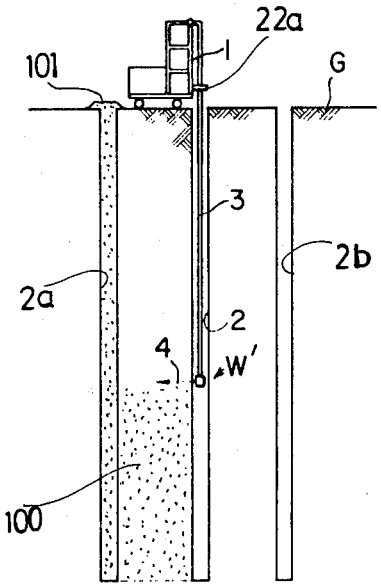
FIG. 1 is a schematic schema showing a preferred embodiment of the improved process according to the present invention.

An improved portable combined digging and grouting machine is shown at 1 in FIG. 1. An elongated pipe rod 3 of a predetermined length, say 30 meters, is mounted at its intermediate point vertically movable on the machine 1. However, this pipe rod can be rotated around its own central axis when occasion desires.

The machine 1 is seen on the earth surface G. As conventionally, the pipe rod comprises a number of pipe rod elements detachably jointed one after another by screw coupling means or the like, although not shown. The pipe rod extends into a hole 2 preparatorily digged into the earth by an auger or the like means. A working head W′ is detachably attached to the lower end of the pipe rod.

Figure 4:
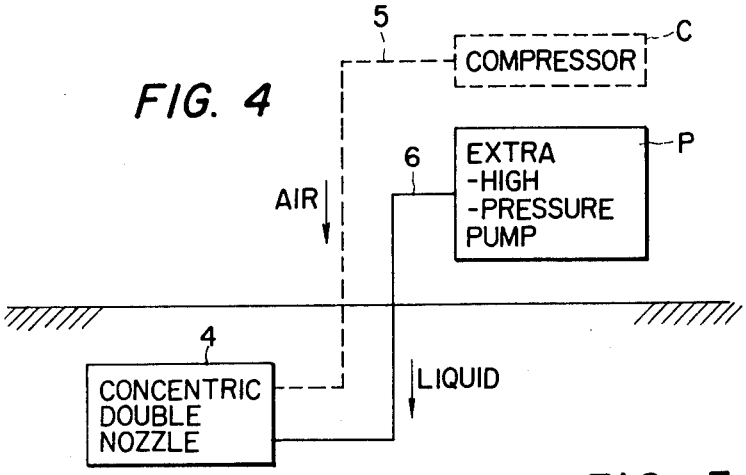
FIG. 4 is a schematic representation of a compressor and a concentric double nozzle unit which are mounted in a portable apparatus adapted for carrying out the inventive process.

The machine 1 comprises an air compressor and a pump which are shown only schematically in the form of a block diagram revealed in FIG. 4. An air pipe 5 extending from the compressor C and a liquid pipe 6 extending from the pump P are connected to a combined swivel and supply assembly S (see FIGS. 2, 3 and 6) attached to the top end of pipe rod 3, having the working head W′ positioned at the lower end of the latter.

Figure 5:
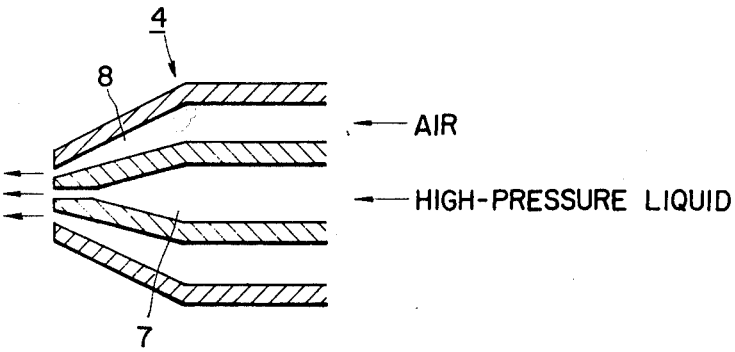

FIG. 5 shows the nozzle 4 more specifically in its longitudinal section, wherein at the center of the nozzle is a liquid-jet passage 7 to which liquid pipe 6 conveys the liquid. Note in FIG. 5 that the center passage 7 is surrounded by air-jet passage 8 which is annular in its transverse cross section and to which air pipe 5 conveys the enveloping air, as will be more fully described hereinafter.

The air supplied by compressor C is released from the air-jet passage 8 while the liquid is discharged from liquid-jet passage 7, so that, when both air and liquid are being discharged, the stream of jet liquid becomes enveloped by the annular stream of air.

When the working head W′, and thus the nozzle 4 is immersed in water, the stream of air from passage 8 envelopes the liquid jet from the core passage 7, isolating the water jet from the surrounding water so that it advances as if the nozzle were being used in the atmosphere of air. This manner of discharge from the nozzle enables to generate and maintain a high-velocity liquid jet for traversing a greater distance than is otherwise possible.

Upon conducting extensive experimental research work, we have discovered that there is an intimate relationship between the distance traversed by the high-velocity liquid jet of the above kind and the velocity of the enveloping ring air jet issueing from the outer air-jet passage 8 of the nozzle assembly 4. The grounds of this relationship will be explained hereinbelow with reference to FIG. 8.

Figure 8:
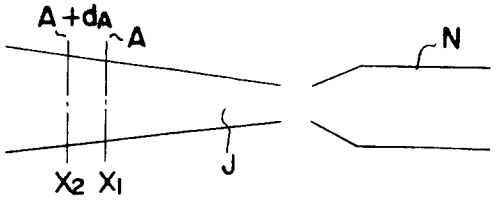
FIGS. 8–11 are several diagrams illustrative of the functional effects of the inventive process.

In FIG. 8, the jet stream J emerging from a nozzle N increases its transverse cross-sectional area as the liquid advances from the nozzle tip. A position $X_1$ of the stream is assumed to be located at a given distance from the nozzle tip and its cross-sectional area is further assumed to have a value A, the corresponding stream velocity being expressed by U. At another position $X_2$, being separated by an infinitesimally small distance from the said position $X_1$, now $dA$ represents an increment of cross-sectional area and $dU$ the corresponding reduction in velocity, both occurring through the small separating distance between these two positions under consideration. Then, we obtain the following equation:

$$dU/U = (dA/A)/(1 - M^2)$$

where $M$ stands for a Mach number.

Theoretically, the denominator in the right-hand member of the above equation approaches to zero if the velocity of the discharging air stream approaches to the unit Mach number 1; and, since $dU/U$ is finite, $dA$ too must approach again to zero. Stating differently, if $M \rightarrow 1$, then $dA \rightarrow 0$, meaning that there is no increase in the cross-sectional area of the jet stream. Applying this relationship to the air jet produced by the ejection of air from the outer air jet passage 8 of the combined nozzle 4, it will be seen that, if the air is ejected at a velocity equal to its unit Mach number, the air jet envelopes the core liquid jet and rushes forward with the center jet. Consequently, the liquid jet does not increase too its cross section and is thus forced to traverse a greater distance.

Figure 9:
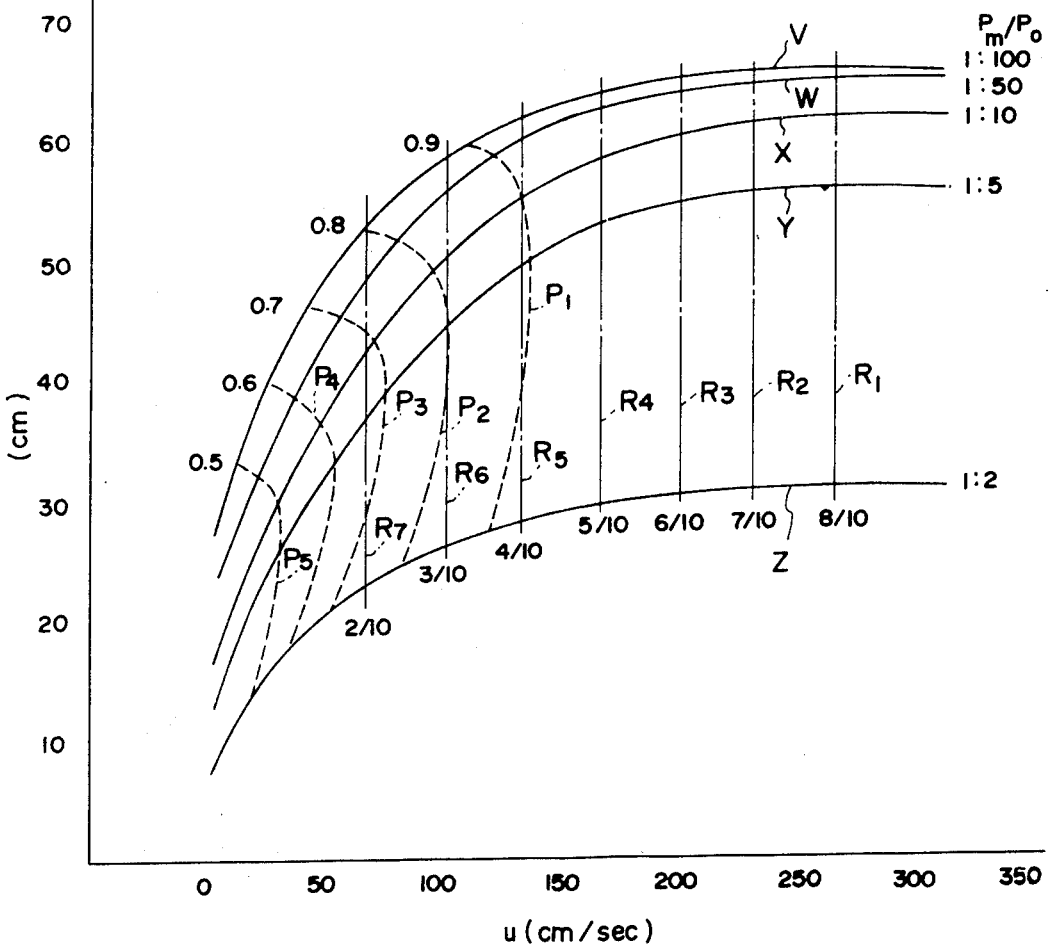

FIG. 9 represents a graph showing the results of experimental tests in which the velocity of the air jet is varied. In this graph, the distance expressed in centimeters from the nozzle is plotted against the air jet velocity in cm/second. In addition, the pressure reduction ratio $P_m/P_o$ is taken as a parameter, $P_m$ representing the pressure in the axial direction of the air jet flow appearing at a variable distance measured from the nozzle outlet and $P_o$ representing the pressure measured at the nozzle outlet. These pressures direct in the liquid direction. Curves V, W, X, Y and Z are plotted for $P_m/P_o$ ratios of 1/100, 1/50, 1/10, 1/5 and 1/2, respectively, in that order. The vertical broken lines $R_1$ through $R_7$, inclusive, represent several selected ratios of the variable air velocity U to the maximum air velocity $U_m$ (of which mention will be made hereinafter). Specifically, these selected ratios are 8/10 for $R_1$, 7/10 for $R_2$, 6/10 for $R_3$, 5/10 for $R_4$, 4/10 for $R_5$, 3/10 for $R_6$, and 2/10 for $R_7$. On the other hand, the sonic speed of air varies with temperature and its range is normally between 330 and 345 m/sec. In the present experiment, $U_{max} = 329$ m/sec is adopted so that one-half the sonic speed amounts to 165 m/sec. The nearly vertically extending broken line curves $P_1$ through $P_5$, inclusive, represent the ratio of traversed distance to the maximum distance $X_{max}$, the ratio being 0.9 for $P_1$, 0.8 for $P_2$, 0.7 for $P_3$, 0.6 for $P_4$ and 0.5 for $P_5$, respectively.

It will be seen in FIG. 9 that the higher the velocity of the air jet, the greater will be the distance traversed by this jet. Curves V through Z, inclusive, flatten out or level off in the region of higher air jet velocity U. In order to secure a traversed distance which is, say, 90% of the maximum traverse distance $X_{max}$ corresponding to the maximum air jet velocity $U_{max}$, the air jet must take a velocity value appearing at the right hand region from curve $P_1$. This means that the air velocity in this case must be at least half the sonic speed.

Figure 6:
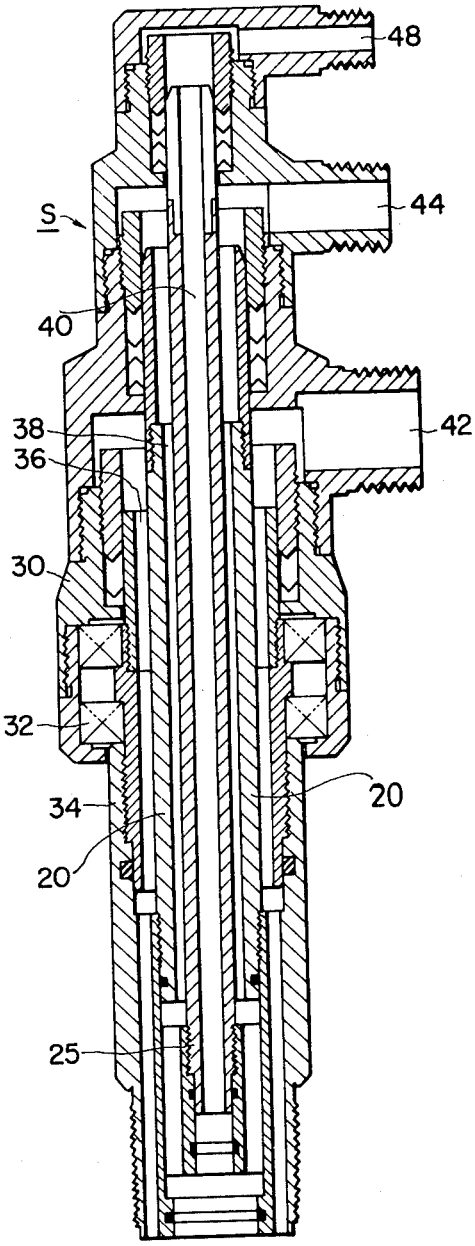
FIG. 6 is a vertical section view of a swivel suspension unit attached to the top end of a pipe rod to be inserted into the vertical hole.

Next, referring to FIG. 6, a preferred embodiment of the combined swivel and supply assembly S.

This assembly S comprises a stationary outer sleeve unit 30 consisting several sleeve parts screw-coupled one after another as shown, a rotatable outer sleeve unit 34 being partially held in and by the said stationary unit 30 through anti-friction bearings 32.

The assembly S further comprises a rotatable and concentric intermediate sleeve unit 20 consisting of several sleeve elements screw-coupled one after another as shown.

An outer cement milk passage 36 is formed between the outer and intermediate sleeve units 34 and 20 which communicates with a lowermost inlet socket 42 made integral with the outer sleeve unit 30 for receiving a cement milk composition preferably having a cement-/water ratio, say 50 : 50. A compressed air passage 38 is formed between the rotatable intermediate and core sleeve units and communicates with an intermediate inlet socket 44 made integral again with the stationary outer sleeve unit for receiving compressed air from the compressor C. A high pressure water passage 40 is provided by the interior space of the core sleeve unit 25 and communicates with an upper socket 48 made integral again with the said stationary outer sleeve unit, for receiving pressurized water from the pump P.

Although not specifically shown on account of its very popularity, pipe rod 3 is built into a triple-walled structure comprising an outer piping, an intermediate piping and a core piping, these pipings being rotatable in unison and each of these pipings comprising a number of pipe elements coupled together. The uppermost pipe elements of these rod pipings are detachably coupled with respective lower ends of the outer, intermediate and core sleeve units, as conventionally.

Figure 7:
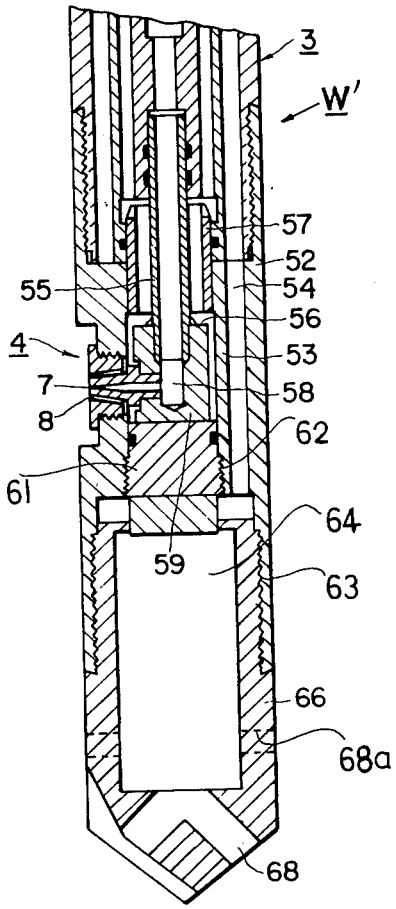
FIG. 7 is a vertical section view of a working head to be attached to the lower end of the pipe rod.

Referring further to FIG. 7, the working head S comprises an outer sleeve 52 having a female-screwed upper end coupled with the outer piping of the rotatable pipe rod 3. There is provided further an intermediate sleeve 53 which is made at its lower end integral with the said outer sleeve. An auxiliary smaller sleeve 57 is attached fixedly to the sleeve 53 by pressure fitting, or welding or the like conventional fixing technique. This auxiliary sleeve is adapted for sealingly receiving the lowermost end of the intermediate piping of the pipe rod 3, as clearly shown.

The head S is further provided with a core sleeve 55 for sealingly receiving the lower end of the core piping of the pipe rod.

There is a mounting piece 59 positioned within and at the center of the head S, receiving snugly and axially the lower end of the core sleeve 55 and at the same time, mounting laterally the double nozzle 4 which was already referred to.

A cement milk passage 54 is formed between outer sleeve 52 and intermediate sleeve 53, thus leading to the corresponding inlet socket 42.

In the similar way as before, compressed air passage 56 and high pressure water passage 58 are formed, leading to the respective inlet sockets 44 and 48, respectively. The bottom end of the intermediate sleeve is tightly closed by a screw plug 61 which has a screwed connection at 62. This plug serves at the same time for mounting the mounting piece 59.

The working head W' is further provided with a hollow tip member 66 which is screwed at 63 into the lower end of outer sleeve 52, the inside space 64 of the tip member serving as a part of the cement milk passage kept in fluid communication with that denoted 54. Two or more inclined outlet passages 68 are provided within the tip member which permanently communicates the inside space 64. As an alternative measure, a plurality of lateral outlet passages may be provided as at 68*a* shown by imaginary lines.

The operation of the foregoing machine is as follows:

It is now assumed that a water tight barrier wall is to be constructed in the earth and along the plane of the drawing paper of FIG. 1.

At first, a number of vertical holes or shafts are digged or bored into the earth, as shown only three thereof in an representative way at 2*a;* 2 and 2*b* in FIG. 1.

In practice, however, the machine 1 may be separated into a crane vehicle 24 and a stationary supporting device 22, the latter being fitted with a power engine and transmission means, not shown, for rotating the pipe rod 3 and driving said compressor C and pump P. These mechanical devices are also highly conventional so that specific representation may be dispensed with.

For initiating the inventive process, crane vehicle 24 and supporting device 22 are positioned in proximity to a selected one at 2 of the holes or shafts above referred to, and then crane 18 of the conventional telescopically expandable type is erected on the vehicle 24 for suspending the swivel and supply unit S coupled with pipe rod 3 and working head W', and by means of its hoisting wire cable 19 and its suspension hook 17.

Then, the crane 18 is so operated to lower the pipe rod assembly 3 into the selected shaft 2 until the working head W' is positioned nearly at the lower end of the shaft 2. A certain rotational movement is applied to pipe rod 3 through a rotatable and releasable grip 22*a* of the conventional design, so as to direct the double nozzle towards the neighboring shaft 2*a* as an example.

Next, compressor C is started to supply compressed air, say of 7 kg/cm$^2$, through the corresponding air passages in the assembly S, pipe rod 3 and working head W' towards the outer nozzle 8 of the double nozzle assembly 4 for the delivery of a ring air jet and then, the pump P is driven to feed high pressure water through liquid passages in the assembly S, pipe rod 3 and working head W' towards the core nozzle 7 for the injection of a water jet surrounded by the ring air jet.

By these jet actions, the earth portion connecting the lower ends of both shafts 2 and 2*a* is fluidically penetrated to communicate with each other. Then, the latter hole or shaft 2*a* acts well as a slime discharge passage, working in the principle of the bubble pump. Even if such slime discharge shaft 2*a* is not provided, the whole plant can function as well, because the idle ring space defined by and between the shaft wall 2 and the pipe rod 3 serves for the similar slime discharge passage.

Then, the crane 24 is started to elevate gradually the pipe rod and the like assembly and at the same time, the cement milk supply pump is operated to feed such milk through the corresponding passages in the unit S, pipe rod 3 and working head W' towards the outlet openings 68 or 68*a,* as occasion may desire, and at a lower level than the axis of core water jet. Then, the crushed and sedimented earth on the bottom of the digged space by the water jet and filled with a mixture of earth and water is solidified into a gradually and upwardly developing cemented wall. For this purpose, the cement may preferably be of the rapid solidifiable character. This earth-cutting and crushed earth-solidifying process at its intermediate step is shown only schematically in FIG. 1 at 100. A slime mass appearing on the ground level G after passage through the neighboring slime shaft 2*a,* having conveyed in the form of a liquid suspension and under the action of a kind of bubble pump, assisted by the pressurized liquid-air-earth mixture prevailing in the upper part of the liquid-cut space 100 in the ground, is shown at 101 in FIG. 1.

The process is continued until the working head W' will appear on the ground surface G.

Figure 2:
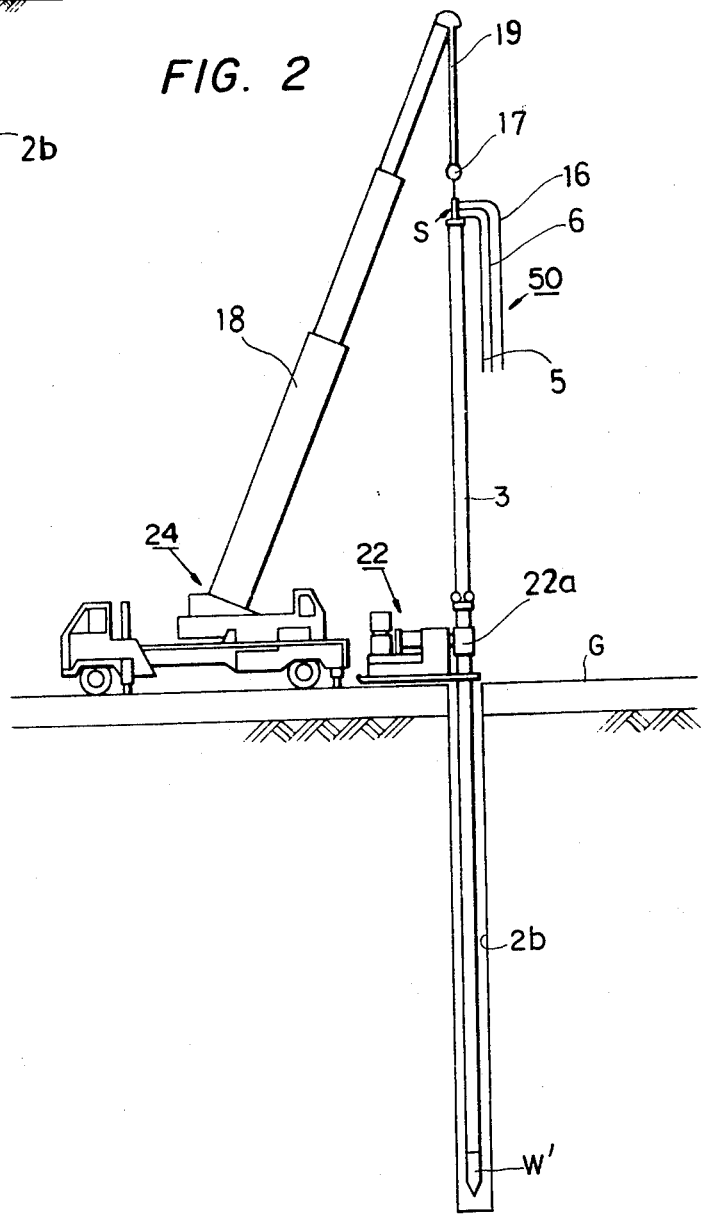
FIG. 2 is a partially sectional view showing a practically first step of the inventive process where the working head unit comprising concentric jet nozzles and a cement milk supplier combined together is placed substantially at the bottom of a vertical hole preparatorily digged into the earth.

Then, the machine 1 is moved to a next position in proximity to the next shaft 2*b* and the pipe rod is again lowered until its working head W' is brought to its initial working position, as shown in FIG. 2, and so on.

In the foregoing operational mode, rotational motion is not applied to the pipe rod assembly including the unit S and head W'. In this case, the cemented barrier wall will be formed within a rather limited space range, connecting the shafts 2*a;* 2 and 2*b.* The cement milk, may be added with any commercialized solidification accelerating agent, if necessary. Core water supply pressure may amount normally to 400–500 kg/cm$^2$. Milk supply pressure may preferably be 10–50 kg/cm$^2$.

Figure 3:
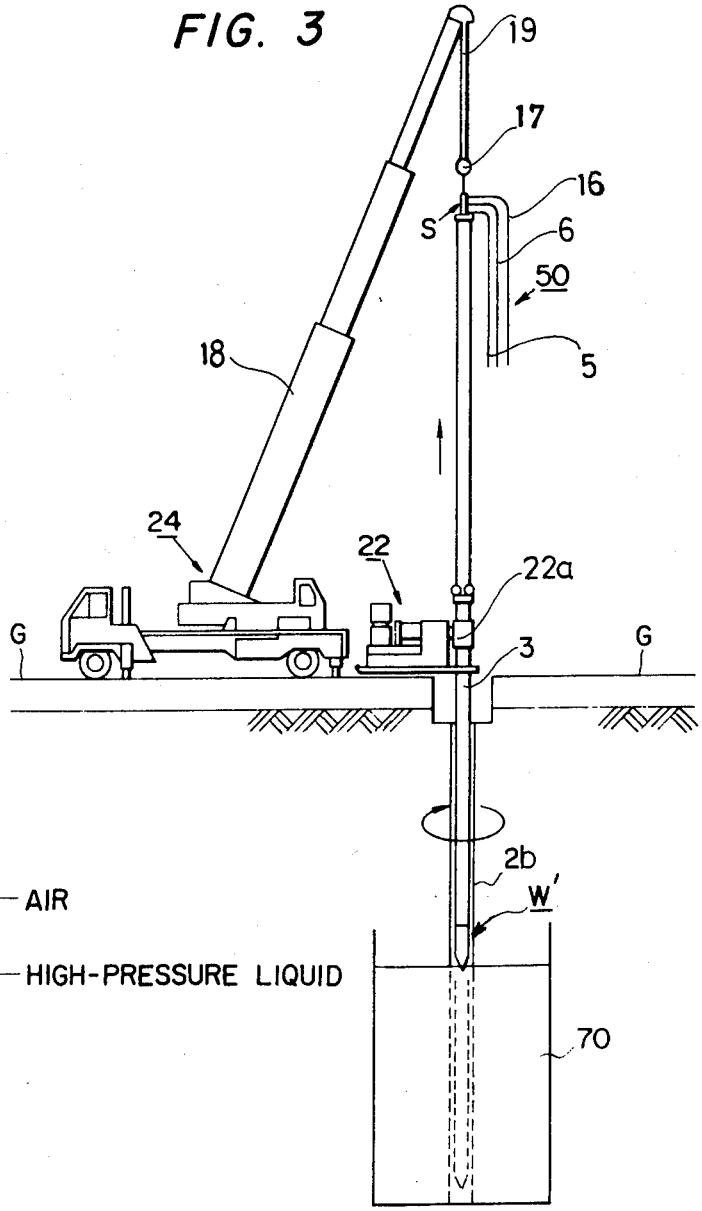
FIG. 3 is a similar view to FIG. 2, showing, however, an intermediate step of the chemical grouting process.

When rotational movement is applied to the pipe rod assembly, the digged and earth-solidified space can be enlarged into a cylindrical space around the vertical axis of the selected shaft as at 2, as schematically shown at 70 in FIG. 3.

Although not shown, cement milk feed pump is preferably mounted on the support device 22 and a feed hose or pipe 16, only partially and schematically shown in FIGS. 2 and 3, extends from the delivery outlet of the pump to the lowest socket inlet 42 of the assembly S. Pipes or hoses 5;6 and 16 are conveniently handled together as at 50 in FIGS. 2 and 3, for convenience of handling thereof during lowering and raising operation of the pipe rod assembly. For this purpose, part of the pipes schematically shown in FIG. 4 may preferably replaced by hoses.

The rate of slime discharged through the slime shaft and appearing on the ground surface G will amount to about 50% of the liquid-crushed earth mass, as an example. More specifically, the resultant slime is forced to appear at the ground surface through guide hole 2*a* or 2*b*, and thus continuously evicted. While this process is in progress, the cement milk is injected into the growing columnar cavity from outlet openings 68 or 68*a* of the working head. The supplied milk mixes with part of the earth being crushed, and the mixture increases in volume to fill up the cavity. After lapse of a certain time duration, the mixture solidifies and thus changes to a cemented mass 100 or 70. This mass 100 or 70 is much like conventional piles driven into the ground, and may serve well as a supporting structure for a building or oil tank, after completion of the scheduled whole underground and on-the-ground construction jobs.

Figure 10:
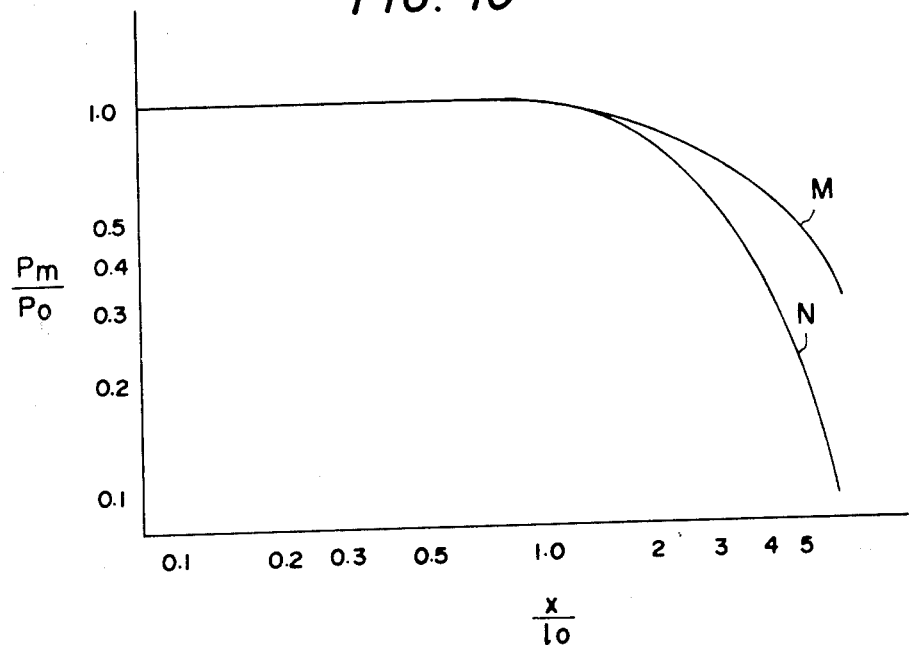
Figure 11:
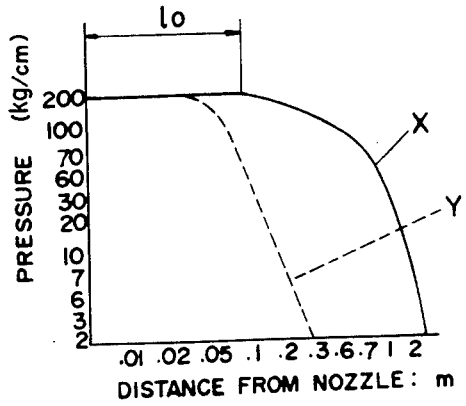

In the graph of FIG. 10, comparison is made of the data taken on a high-velocity liquid jet shot out into the air with that enveloped with a ring air jet, both being directed into a water mass according to the method according to this invention. Curve M represents the former experiment, while curve N the latter. These two curves must not be construed as determining the distance traversed by either jet as a function of $P_m/P_o$; they tell at what point in the length of the jet a certain pressure drop occurs. Note that $P_m/P_o$ is scaled on vertical axis of the graph, and the ratio of actual jet penetration distance (or jet length) to the initial region $l_o$ of the jet is scaled on the horizontal axis. That portion of primary interest of the curve is the flat portion (FIG. 11). It will be seen that the length of initial region $l_o$ is practically the same for the two identical liquid jets, one being directed into the air without any protecting air jet and the other being directed into the water and accompanying a protecting jet.

The meaning of the "initial region $l_o$" will become apparent with reference to FIG. 11. The curves X and Y stand for the same high-velocity liquid jet, having an initial (nozzle outlet) pressure of 200 kg/cm$^2$. Curve X refers to the jet directed into the air and curve Y to the same without any assistance of the protecting air jet directed into the water. In the latter case, jet pressure $P_m$ starts to fall earlier than in the former, resulting in a shorter initial region $l_o$. Comparison of curve Y (of FIG. 11) with curve N (of FIG. 10) clearly suggests superior merits of the method of this invention.

As an example of the merit of the present invention, it should be noted the resulted columnlike cemented cylindrical mass will have a diameter of 0.8–1.6 meters when the pipe rod is rotated around together with its working head W'.

The pipe rod proper 3 comprises three concentric passages wherein the core passage is adapted for allowing passage of said liquid, the intermediate passage is used for compressed air and the outermost passage is used for said cement milk. It is seen that in this way, the smallest possible pressure medium is allowed exclusively to flow the outermost passage, while the highest possible pressure medium will flow through the core passage. In this way, most effecient design for rigidity of the pipe rod proper is positively assured.

Separate and independent extrusion of the cement milk from the liquid-air combined jet acting at a lower level than the latter, the earth-penetrating job and the cement milk-application can be executed concurrently, yet separately. Only in this way, desirous slime-discharging effect is positively assured. At the same time, the earth-cutting operation is highly accentuated, by virtue of the provision of a kind of liquid-and-gas purging means. When utilizing such combined and concentric liquid-air jet as conventionally known by the teachings of U.S. Pat. No. 3,802,203 wherein at least part of liquid jet contains earth-solidifying agent, slime could be discharged, since any discharge of the liquid will invite a considerable loss of the solidifying agent which is naturally very much costly. In the process according to the invention, the liquid containing no such agent will act to cut into the earth for crushing same, while the resulted bubbled water-and-earth mixture is gradually discharged through the slime shaft or the like and the remained such mixture will be gradually solidified and cemented from below.

The embodiments of the invention in which an exclusive property or privilege is claimed are as follows:

1. Process for the formation of an underground cemented earth mass, comprising the steps of injecting a combined and concentric liquid-and-gas jet laterally from a gradually elevating first point within the earth for fluidically penetrating thereinto and cutting thereof, and grouting continuously from a second point with a cement milk separately from said jet and at a lower level than the latter for solidifying a mixture of the cut and crushed earth with the said liquid gradually from below, said second point being elevated gradually and concurrently with said first point.

2. Process of claim 1, further comprising purging part of said cut and crushed earth mixture with the liquid for purging part of the accumulated pressure in the cavity formed by the injected liquid jet, and as a slime.

3. Process of claim 1, further comprising rotating said first and second points concurrently at same rotational speed and phase and around a vertical axis.

4. Process of claim 1 wherein the liquid is water, and the gas is air.

5. Process of claim 1 wherein the injection velocity of the air jet is at least a half the sonic velocity.

6. Apparatus for the formation of an underground cemented structure wherein a concentric triple-walled pipe rod proper is fitted at its upper end with a swivel and supply assembly adapted for receiving separately compressed air, pressure liquid and pressurized cement milk and for being vertically movably and rotatably suspended, and at its lower end with a working head comprising a laterally directing and concentrically arranged double jet nozzle, having a core nozzle element and an outer ring nozzle element, said core nozzle element being adapted for injecting a liquid core jet containing no earth-solidifying agent and at a high velocity at least equal to a half the sonic one and the outer ring nozzle element being adapted for injecting a ring gas jet enveloping said liquid core jet, and said working head is provided with cement milk discharge means positioned at a lower level than the said double jet nozzle.

7. Apparatus of claim 6 wherein said triple-walled pipe rod proper comprises three concentric passages, the core passage adapted for allowing passage of said liquid, the intermediate passage being for compressed air and the outermost passage being for said cement milk.

* * * * *